US009944068B2

(12) United States Patent
Sato et al.

(10) Patent No.: US 9,944,068 B2
(45) Date of Patent: Apr. 17, 2018

(54) DROPLET EJECTION CONTROL APPARATUS, DROPLET EJECTION CONTROL METHOD, AND DROPLET EJECTION APPARATUS

(71) Applicant: SEIKO EPSON CORPORATION, Tokyo (JP)

(72) Inventors: Hiroki Sato, Nagano (JP); Naoki Sudo, Nagano (JP); Tomoyuki Nakano, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/492,298

(22) Filed: Apr. 20, 2017

(65) Prior Publication Data

US 2017/0313057 A1 Nov. 2, 2017

(30) Foreign Application Priority Data

Apr. 28, 2016 (JP) ..... 2016-090386

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586; B41J 2/04508; B41J 2/2139
See application file for complete search history.

(56) References Cited

U.S. PATENT DOCUMENTS

| | | | | |
|---|---|---|---|---|
| 9,340,035 | B2 * | 5/2016 | Sudo | B41J 2/2146 |
| 2011/0234673 | A1 | 9/2011 | Ueshima | |
| 2015/0220001 | A1 | 8/2015 | Sato et al. | |
| 2015/0224761 | A1 | 8/2015 | Sato et al. | |
| 2015/0258785 | A1 | 9/2015 | Sudo et al. | |
| 2015/0258807 | A1 | 9/2015 | Sudo et al. | |
| 2015/0283804 | A1 | 10/2015 | Sato et al. | |
| 2015/0283823 | A1 | 10/2015 | Fukazawa et al. | |
| 2015/0375409 | A1 | 12/2015 | Sato et al. | |
| 2015/0375499 | A1 | 12/2015 | Sato et al. | |
| 2015/0375500 | A1 | 12/2015 | Sato et al. | |
| 2015/0375503 | A1 | 12/2015 | Sato et al. | |
| 2016/0144613 | A1 | 5/2016 | Fukazawa et al. | |
| 2016/0229178 | A1 | 8/2016 | Fukazawa et al. | |
| 2016/0297192 | A1 | 10/2016 | Sato et al. | |

FOREIGN PATENT DOCUMENTS

| | | | |
|---|---|---|---|
| JP | 2001-315318 | A | 11/2001 |
| JP | 2011-201121 | A | 10/2011 |
| JP | 2015-145085 | A | 8/2015 |

(Continued)

*Primary Examiner* — Thinh H Nguyen

(57) ABSTRACT

In a droplet ejection control apparatus according to the invention, a judgment section judges, taking a dot position that is assigned by a predetermined nozzle (incorrect ejection position) as a reference, whether or not a printing state is such that a second proximity dot lands earlier than a first proximity dot. A changing section changes an ejection state, when the ejection state is judged to be such that the second proximity dot lands earlier than the first proximity dot, to another ejection state in which the first proximity dot lands earlier than the second proximity dot.

12 Claims, 9 Drawing Sheets

(56) References Cited

FOREIGN PATENT DOCUMENTS

| | | | |
|---|---|---|---|
| JP | 2015-150751 | A | 8/2015 |
| JP | 2015-174394 | A | 10/2015 |
| JP | 2015-174395 | A | 10/2015 |
| JP | 2015-196340 | A | 11/2015 |
| JP | 2015-196368 | A | 11/2015 |
| JP | 2016-007818 | A | 1/2016 |
| JP | 2016-007824 | A | 1/2016 |
| JP | 2016-007825 | A | 1/2016 |
| JP | 2016-097636 | A | 5/2016 |
| JP | 2016-132150 | A | 7/2016 |
| JP | 2016-132151 | A | 7/2016 |
| JP | 2016-144902 | A | 8/2016 |

* cited by examiner

DROPLET EJECTION CONTROL APPARATUS, DROPLET EJECTION CONTROL METHOD, AND DROPLET EJECTION APPARATUS

BACKGROUND

1. Technical Field

The present invention relates to droplet ejection control apparatuses, droplet ejection control methods, and droplet ejection apparatuses configured to perform proximity complement.

2. Related Art

In an ink jet printer, there is a case in which some trouble occurs in a certain nozzle and the stated nozzle cannot eject a droplet any more. Such nozzle will be referred to as a "void nozzle" hereinafter.

As such, a complementary recording method in which a section corresponding to a void nozzle is complemented by changing a dot size of a nozzle in the proximity of the void nozzle is known.

JP-A-2001-315318 discloses a technique in which a dot lack of a void nozzle is made to be inconspicuous by causing a dot ejected through a nozzle adjacent to the void nozzle to become large.

Meanwhile, JP-A-2011-201121 discloses that, at a dot position corresponding to a void nozzle, a dot lack of the void nozzle is likely to be conspicuous due to interference generated by a dot-landing that takes place in the proximity of the above dot position.

SUMMARY

There has been a case in which a void nozzle is likely to be conspicuous at a dot position corresponding to the void nozzle due to interference generated by a dot-landing that takes place in the proximity of the above dot position.

An advantage of some aspects of the invention is to make a dot position of a void nozzle unlikely to be conspicuous.

An aspect of the invention is a droplet ejection control apparatus that causes a droplet ejection apparatus including a head in which a plurality of nozzles are disposed being aligned in a predetermined direction to perform printing. The droplet ejection control apparatus is so constituted as to include a judgment section that judges, taking a certain incorrect ejection position as a reference, whether or not a printing state is such that a second proximity dot lands simultaneously with or earlier than a first proximity dot; and a changing section that changes, when it is judged that an ejection state is such that the second proximity dot lands earlier than the first proximity dot, the ejection state to an ejection state in which the first proximity dot lands earlier than the second proximity dot.

With this structure, the droplet ejection control apparatus causes the droplet ejection apparatus including the head in which the plurality of nozzles are disposed being aligned in the predetermined direction to perform printing.

In this case, the judgment section takes a certain incorrect ejection position as a reference, and judges whether or not the printing state is such that the second proximity dot lands earlier than the first proximity dot. For example, by referring to raster data in a state in which a transport direction of the head, a feeding amount of paper, and the like are specified, it can be judged whether or not the printing state is such that the second proximity dot lands earlier than the first proximity dot.

The changing section changes, when it is judged that the ejection state is such that the second proximity dot lands earlier than the first proximity dot, the ejection state to an ejection state in which the first proximity dot lands earlier than the second proximity dot. For example, the ejection state can be changed to an ejection state in which the first proximity dot lands earlier than the second proximity dot by changing the transport direction of the head, the feeding amount of paper, or the like.

In the ejection state in which the second proximity dot lands earlier than the first proximity dot, the first proximity dot is attracted in a direction toward the second proximity dot side. In other words, with a predetermined dot position that corresponds to a void nozzle being taken as a reference, the first proximity dots are attracted in a direction toward both sides relative to the reference position. As a result, filling the predetermined dot position corresponding to the void nozzle, which is originally intended to do, becomes hard to realize.

However, in the case where the first proximity dot lands earlier than the second proximity dot, the first dot is not attracted in a direction toward the second proximity dot side. As a result, the first proximity dot spreads toward the predetermined dot position corresponding to the void nozzle, thereby making it possible to fill the stated dot position as originally intended to be filled.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an embodiment of the invention will be described with reference to the drawings.

Figure 1:
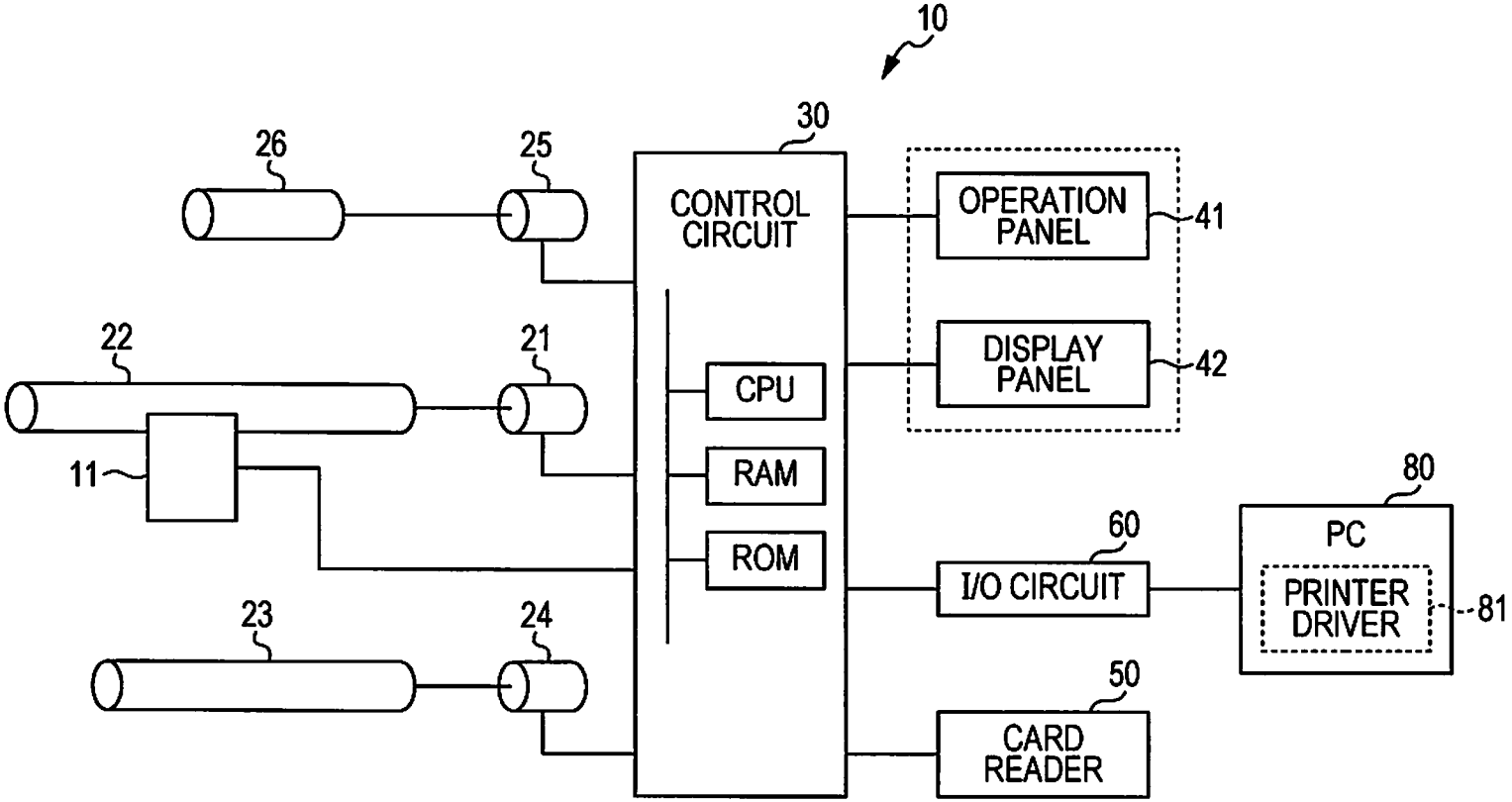
FIG. 1 is a schematic block diagram of an ink jet printer to which the invention is applied.

FIG. 1 is a schematic block diagram of an ink jet printer to which the invention is applied.

In FIG. 1, a printing head (head) 11 of a printer (droplet ejection apparatus) 10 ejects color inks of four or six colors, which are supplied from ink tanks, through nozzles. The printing head 11 is so driven as to move back and forth in a predetermined range by a belt 22 driven by a carriage motor 21. A platen 23 is driven by a platen motor 24 and transports paper in response to the reciprocating movement of the printing head 11. A feed motor 25 drives a feed roller 26 for supplying paper that is stored in a predetermined paper stacker. The printer of this type in which the printing head 11 moves back and forth in accordance with the transport of paper in the manner described above, is called a serial printer. In the serial printer, an alignment direction of a nozzle row is parallel to a paper feeding direction. It is to be noted that "paper feeding" is also called "medium feeding".

A control circuit 30 is configured by combining dedicated ICs so as to include a CPU, a ROM, and a RAM in terms of functionality. The control circuit 30 controls the driving of the printing head 11, the carriage motor 21, the platen motor 24, and the feed motor 25. An operation panel 41 and a display panel 42 are attached to the control circuit 30. The operation panel 41 receives predetermined operations by a user, and the display panel 42 displays predetermined representations thereon. The above hardware configuration is collectively referred to as a printing mechanism.

A card reader 50 is connected to the control circuit 30, which makes it possible, by mounting an attachable/detachable memory card, to read in the data stored in the memory card, record predetermined data, and so on. Further, an I/O circuit 60 is connected to the control circuit 30, thereby making it possible to connect with other external devices through wire or wireless communications. The control circuit 30 acquires an image data file from the external device, memory card, or the like, and executes printing based on the acquired data file while controlling the above-described constituent devices. Note that the control circuit 30 is connected to an external PC 80 through the I/O circuit 60. The PC 80 generates predetermined print control data using an internal printer driver 81 and sends the generated data to the control circuit 30.

Figure 2:
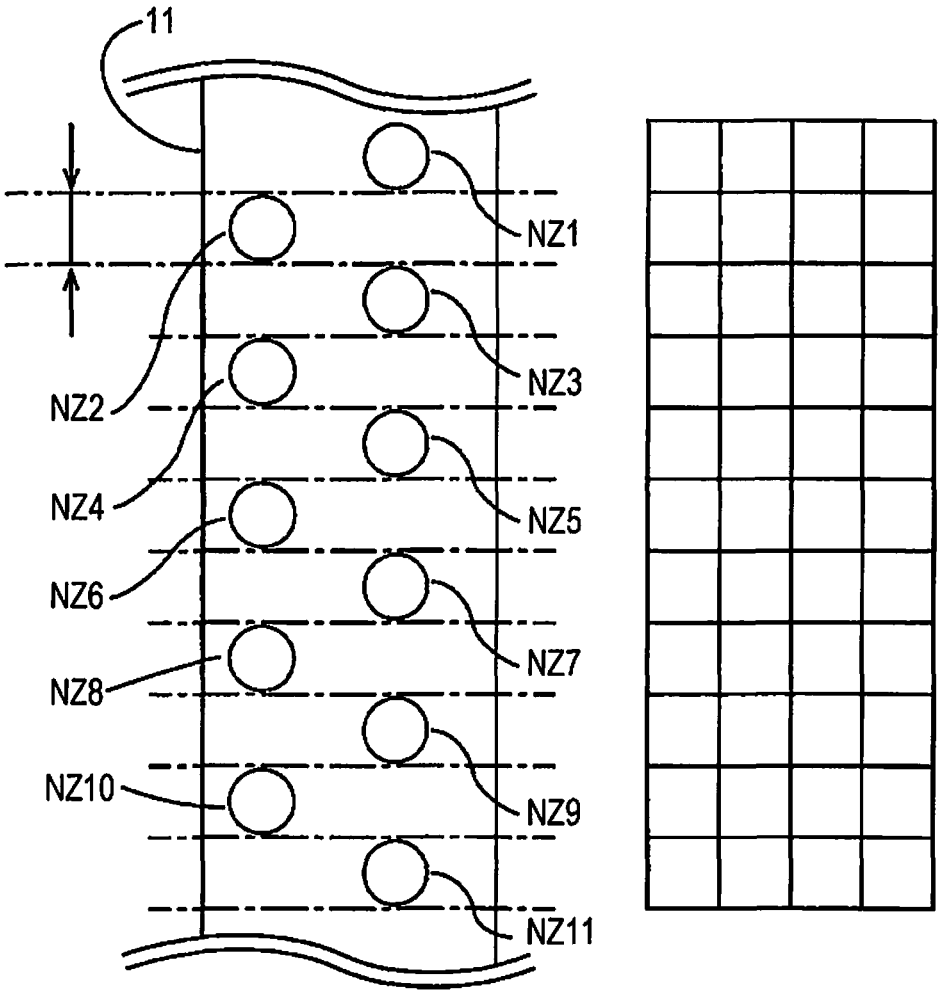
FIG. 2 is a schematic diagram illustrating a nozzle row of a printing head.

FIG. 2 is a schematic diagram illustrating a nozzle row of the printing head.

In the printing head 11 to which color ink is supplied, a plurality of nozzles for ejecting ink droplets of the color ink are formed. In this embodiment, a plurality of nozzles NZ1 to NZ11 are formed being aligned in two rows in a zigzag manner (zigzag pattern). As shown in the drawing, the nozzles including the nozzle Z1 on the upper side to the nozzle Z11 are disposed in a zigzag manner, whereby a pitch between the nozzles is substantially the same as the diameter of a dot. A nozzle row configured of the nozzles NZ1, NZ3, NZ5, NZ7, NZ9 and NZ11 each assigned a reference numeral of odd number and a nozzle row configured of the nozzles NZ2, NZ4, NZ6, NZ8 and NZ10 each assigned a reference numeral of even number are shifted from each other by one pixel in a nozzle row direction. As a result, in the case where the printing head 11 scans once in a predetermined direction on the paper, all the pixels in a region corresponding to a length of the nozzle row can be printed at a time by using all of the nozzles NZ1 to NZ11.

In contrast, in the case where the pitch between the nozzles is wider than the diameter of the dot, a region between the nozzles is filled with an ink droplet ejected through another nozzle by controlling the feeding amount of paper.

In the case of using the printing head 11 shown in FIG. 2, when one of the nozzles has become a non-ejection nozzle, an ink droplet is not ejected on a region to which the non-ejection nozzle faces, thereby raising a possibility of appearance of a white stripe. A proximity complement to deal with this issue will be described hereinafter.

Figure 3:
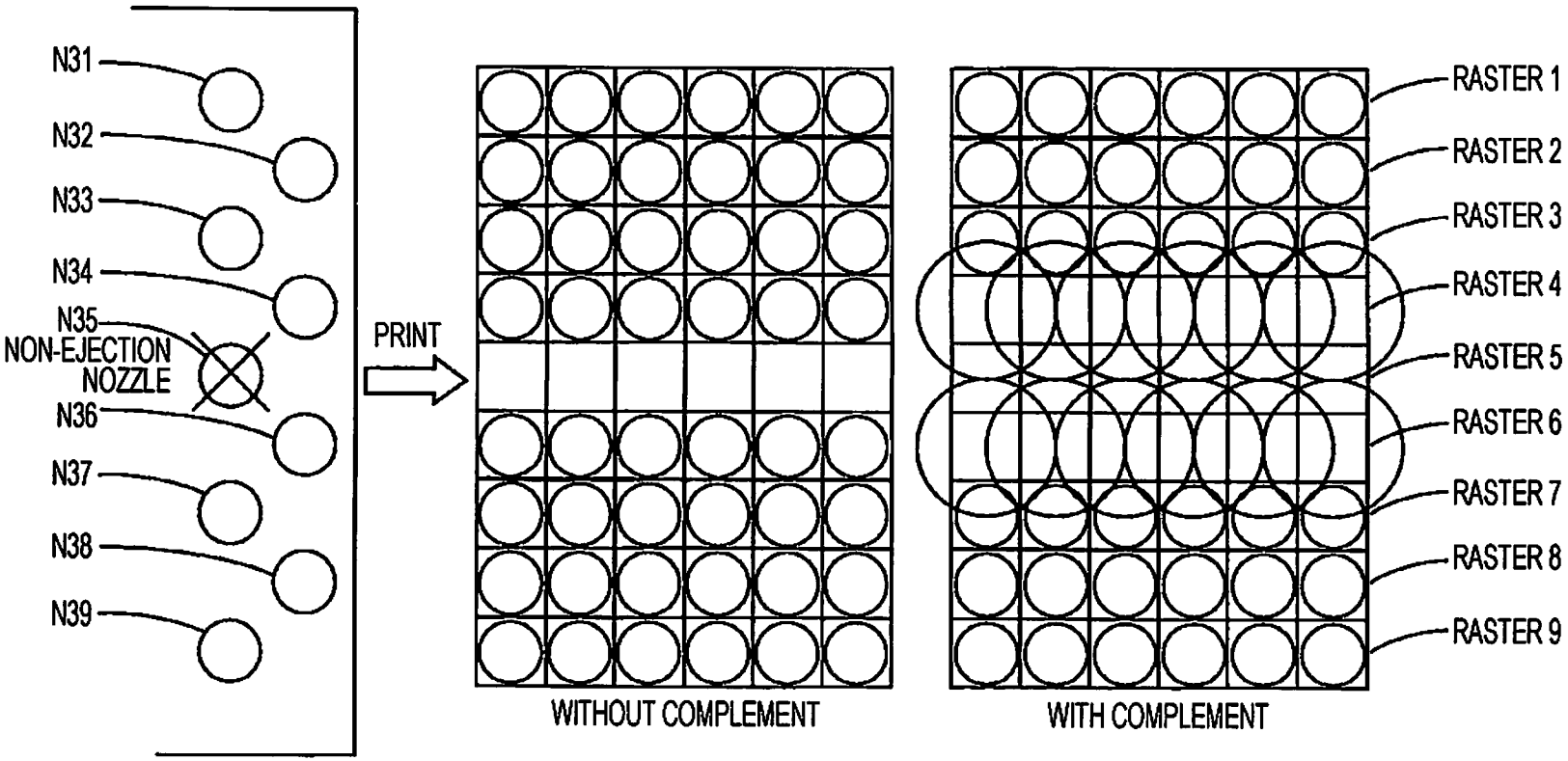
FIG. 3 is a diagram illustrating a proximity complement in the case where there exists a non-ejection nozzle.

FIG. 3 illustrates a proximity complement in the case where there exists a non-ejection nozzle.

In FIG. 3, if a nozzle N35 is a non-ejection nozzle and the proximity complement is not performed, an ink droplet is not assigned to a raster 5 as shown in a diagram at the center of FIG. 3 without the proximity complement being performed. In this case, the raster 5 becomes a white stripe. However, as shown in a diagram of FIG. 3 with the proximity complement being performed, in the case where a dot size of each ink droplet of nozzles N34 and N36 configured to assign ink droplets to rasters 4 and 6 each adjacent to the raster 5 is made larger, because the dots having been made larger spread from the sides of the raster 4 and raster 6 toward the raster 5, the white line in the raster 5 becomes inconspicuous. The rasters 4 and 6 are referred to as "first proximity" relative to the raster 5. The nozzles that eject the first proximity dots are not limited to nozzles adjacent to each other. However, in the case where a nozzle pitch matches a dot pitch like in this embodiment, the stated nozzles also have a positional relationship of being adjacent to each other.

Figure 4:
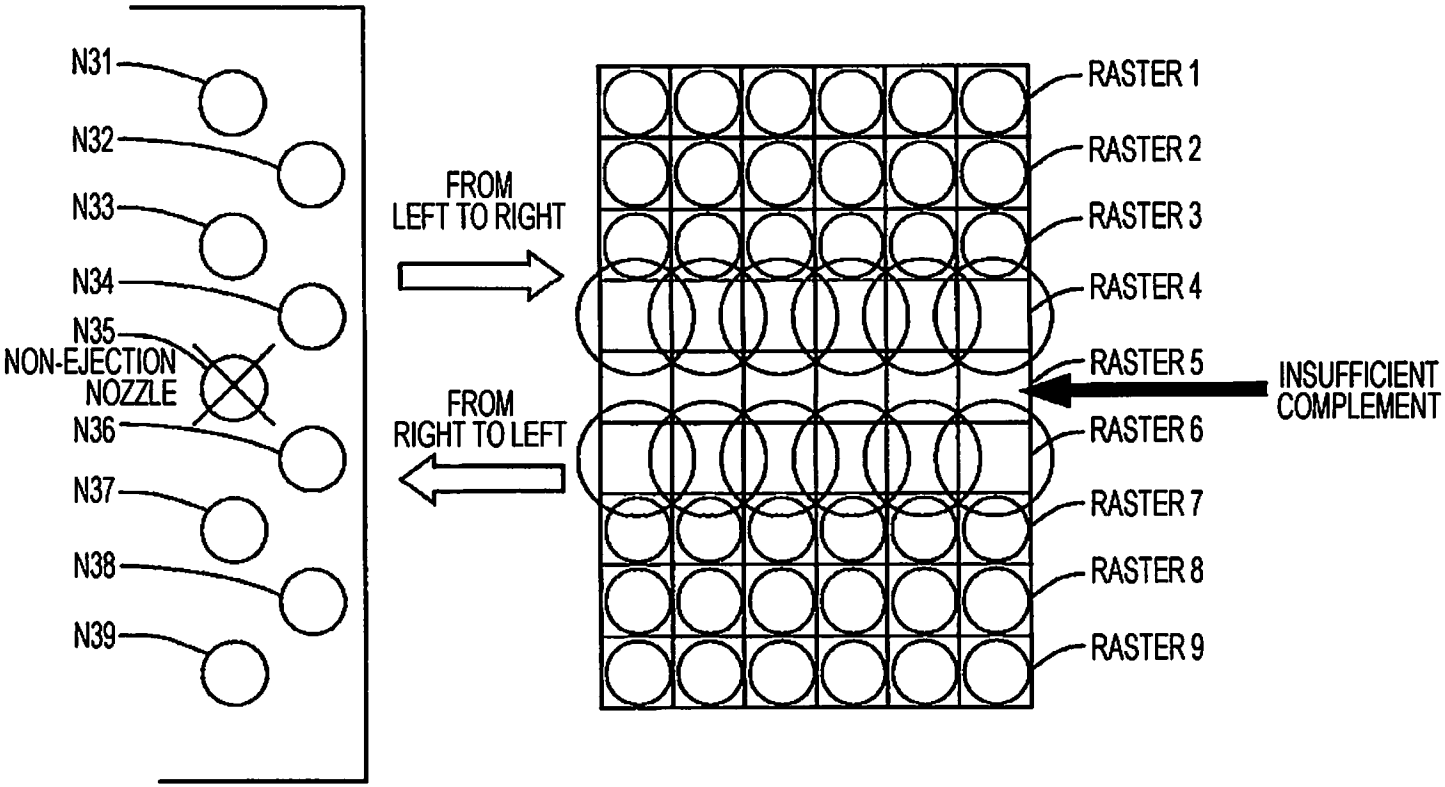
FIG. 4 is a diagram illustrating a state in which a proximity complement is influenced by a second proximity ink droplet in the case where there exists a non-ejection nozzle.

FIG. 4 illustrates a state in which a proximity complement is influenced by a second proximity ink droplet in the case where there exists a non-ejection nozzle. In FIG. 4, a movement direction of the printing head 11 in a line direction is indicated by arrow marks. The arrow mark on the upper side indicates a direction in which the printing head 11 moves from left to right, while the arrow mark on the lower side indicates a direction in which the printing head 11 moves from right to left.

As indicated by the arrow mark on the lower side, in the case where the printing head 11 moves from right to left, the printing state becomes as follows. That is, although an ink droplet is not ejected onto the raster 5, ink droplets are ejected onto rasters 3 and 7 as second proximity. In a case where ink droplets are attached to the rasters 4 and 6 immediately after ink droplets being attached to the rasters 3 and 7, because surface tension acts on the ink droplets on the paper, the droplets on the rasters 4 and 6 are attracted in a direction toward the side of the ink droplets previously attached to the rasters 3 and 7 rather than spread toward the raster 5 side. Because of this, as shown in a diagram on the right in FIG. 4, the ink droplets on the raster 4 and 6 are dried before spreading toward the raster 5 side and consequently cannot sufficiently fill the raster 5, thereby bringing about a situation where a white stripe can be visually recognized.

As discussed above, depending on whether the ink droplets are attached earlier to the rasters 3 and 7 as the second proximity or attached earlier to the rasters 4 and 6 as the first proximity, an effect of the proximity complement differs. Whether the droplets are attached to the second proximity earlier or attached to the first proximity earlier changes depending on a direction in which the printing head 11 scans on the paper. That is to say, even if the proximity complement is performed in the case where the nozzle N35 is a non-ejection nozzle, the effect of the proximity complement changes depending on the direction to which the printing head 11 faces during the scanning on the paper.

As discussed above, the printing head 11 includes a plurality of nozzle rows disposed at the positions where raster line positions of the respective nozzles N31 to N39 are different. As such, the first proximity and the second proximity are reversed in accordance with the movement direction of the printing head 11.

Figure 5:
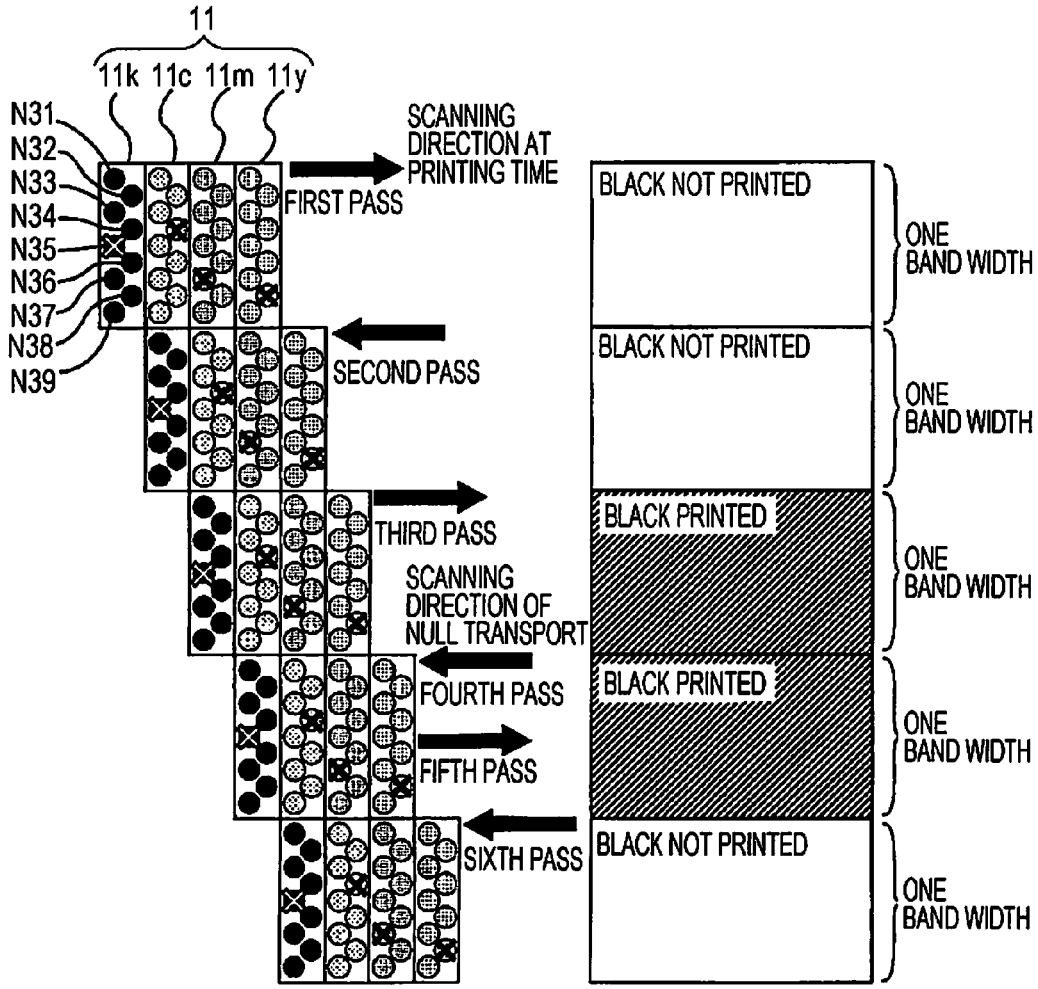
FIG. 5 is a diagram illustrating a printing state using a printing head.
Figure 6:
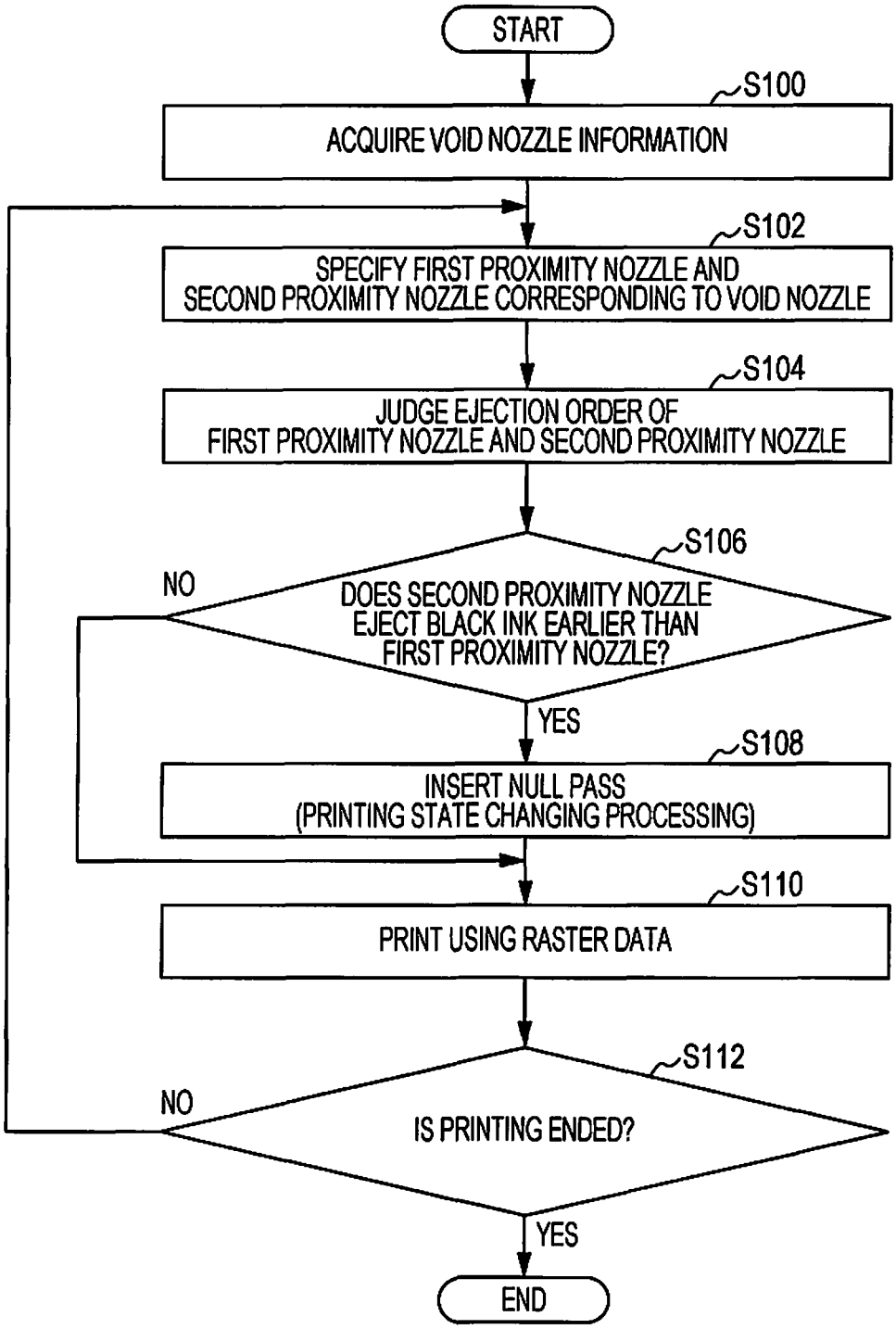
FIG. 6 is a flowchart of a print process in which a desired printing state is realized.

FIG. 5 illustrates a printing state using a printing head, and FIG. 6 is a flowchart of a print process in which the printing state is realized.

This print process is carried out in accordance with raster data. Although the process is executed by the printer driver 81 of the PC 80, it can also be executed by the control circuit 30 in the printer 10. The CPU configured to execute a predetermined program carries out the process following the flowchart. As such, the PC 80, the control circuit 30, or the like substantially corresponds to a control unit of the droplet ejection control apparatus.

The CPU acquires information on a void nozzle in S100. As for nozzles in FIG. 5 and FIG. 6, the nozzle N35 is a non-ejection nozzle with respect to black ink, and information telling that the nozzle N35 is a void nozzle is acquired. The void nozzle is not limited to only a non-ejection nozzle, and may be such a nozzle that is capable of ejecting droplets but has a large error in droplet-landing precision so that the nozzle is intentionally prevented from ejecting the droplets. Such abnormal-ejection nozzle can be found in advance using a predetermined print check pattern, or detected by sending an electric control signal to the actuator of the nozzle.

Upon acquiring the void nozzle information, printing is performed in accordance with the raster data. In this embodiment, because the printing in a print region of each band width is completed by scanning once, paper feeding is performed every pass by one band width so that the print process is carried out every pass in accordance with the raster data of one band width.

The CPU specifies, in S102, a first proximity nozzle and a second proximity nozzle respectively configured to eject a first proximity dot and a second proximity dot while taking the raster data of one band width corresponding to a position in a line direction of the printing head 11 as a target to be processed and taking a dot corresponding to the void nozzle as a reference. In the case where the nozzle N35 is a void nozzle, as discussed above, the first proximity nozzles are the nozzles N34 and N36, and the second proximity nozzles are the nozzles N33 and N37. The nozzles N34 and N36 are the first proximity nozzles not because they are adjacent to the void nozzle N35 but because they eject ink droplets to form dots respectively adjacent to the dots formed with the ink droplets ejected through the void nozzle N35. The nozzles N33 and N37 are the second proximity nozzles because they eject ink droplets to form dots respectively adjacent to the dots formed with the ink droplets ejected through the nozzles N34 and N36. The first and second proximity nozzles are specified in consideration of the nozzle arrangement, the nozzle pitch, and so on of the printing head in use.

Next, in S104, the CPU judges the ejection order of the first proximity nozzle and the second proximity nozzle.

In FIG. 5, the printing head 11 includes printing heads 11*k*, 11*c*, 11*m*, and 11*y* respectively corresponding to color inks of four colors of KCMY (represents black, cyan, magenta, and yellow), and these heads are disposed being aligned in a direction in which the printing head 11 traverses the paper. The description will be given assuming that the nozzles of each of the printing heads 11*k*, 11*c*, 11*m*, and 11*y* are disposed in the same manner as the nozzles shown in FIGS. 3 and 4. Note that in the following process, the discussion will be focused on black ink, which makes a white stripe likely to appear most conspicuously. Regions in which printing is performed by the printing head 11 scanning are illustrated on the right side in FIG. 5. Print regions are sequentially formed on a band-width by band-width basis from the top. Black ink is not ejected in the two regions from the top (black-not-printed regions); in the two regions on the lower side of the above-mentioned regions, black ink is ejected (black-printed regions); and black ink is not ejected in the last region (black-not-printed region).

In FIG. 5, a first pass is executed at the start of printing. In the first pass, the printing head 11 performs printing by ejecting droplets while moving from left to right on the depiction of FIG. 5.

In the case where the first proximity nozzles are N34, N36 and the second proximity nozzles are N33, N37 when the void nozzle N35 is taken as a reference nozzle, the nozzles N34 and N36 serving as the first proximity nozzles eject ink droplets earlier when the printing head 11 moves from left to right on the depiction of FIG. 5. The nozzles N33 and N37 serving as the second proximity nozzles eject ink droplets later.

Thereafter, in S106, the CPU judges whether or not the second proximity nozzle ejects black ink earlier than the first proximity nozzle. Because black ink is not ejected and the first proximity nozzle ejects ink droplets earlier in the first pass, printing is performed using the raster data in S110 without executing processing of S108.

Upon finishing the printing of one pass of raster data, it is judged in S112 whether or not the printing is ended. In this case, because a second pass and its subsequent passes remain to be executed, the print process repeats S104 and its subsequent processing without stopping the printing.

In the second pass, the printing head 11 performs printing by ejecting ink droplets while moving from right to left on the depiction of FIG. 5. In this case, the nozzles N33 and N37 serving as the second proximity nozzles eject ink droplets earlier, while the nozzles N34 and N36 serving as the first proximity nozzles eject ink droplets later. However, when it is judged in S106 whether or not the second proximity nozzle ejects black ink earlier than the first proximity nozzle, printing is performed in S110, like in the first pass, using the raster data without executing the processing of S108 because black ink is not ejected also in the second pass. The process discussed thus far is carried out in a third pass in the same manner even when black ink is ejected in the third pass.

However, in a fourth pass, because black ink is ejected and the second proximity nozzle ejects ink droplets earlier than the first proximity nozzle, the CPU inserts a null pass in S108 (printing state changing processing), unlike in the passes described above. Inserting the null pass means that the printing head 11 is once moved from a position at a right end to a position at a left end without ejecting ink droplets therefrom. In this case, the "right end" and "left end" are the terms corresponding to the raster data and referring to an end portion and another end portion in a range including a range of the print region corresponding to the raster data.

Following the null pass being inserted in the fourth pass, printing is performed in a fifth pass. Although the printing in the fifth pass is unchanged such that black ink is ejected according to the current raster data, and the nozzles that eject ink droplets earlier are the nozzles N34 and N36 serving as the first proximity nozzles while the nozzles N33 and N37 serving as the second proximity nozzles eject ink droplets later. Accordingly, the proximity complement performed in the manner in which large size dots are assigned from the nozzles N34 and N36 serving as the first proximity nozzles brings an effect in which the above large size dots spread to the dot position of the void nozzle N35 as expected.

By carrying out the print process in a sixth pass and its subsequent passes in the same manner, favorable proximity complement results can be expected. After finishing the printing using all the raster data, it is judged, in S112, that the printing is ended, and then the printing process is ended.

As described above, by the processing from S100 to S106, it is judged whether or not the printing state is such that the second proximity dot lands earlier than the first proximity dot, while taking a dot position to which a predetermined nozzle represented by a non-ejection nozzle assigns a dot position (the stated dot position corresponds to an incorrect ejection position) as a reference; these processings correspond to a judgment section. Further, in the case where it is judged that the ejection state is such that the second proximity dot lands earlier than the first proximity dot, the ejection state is changed, by S108, to an ejection state in which the first proximity dot lands earlier than the second proximity dot; therefore, the processing in S108 corresponds to a changing section.

Further, in this embodiment, the judgment section judges, taking a certain incorrect ejection position as a reference, whether or not the landing order is such that the second proximity dot lands earlier than the first proximity dot; in the case where it is judged that the second proximity dot lands earlier than the first proximity dot, it can be said that the changing section reverses the landing order.

In the embodiment, as a proximity complement, a process in which large size dots are assigned from the nozzles N34 and N36 serving as the first proximity nozzles is explained. However, it is not absolutely necessary for the proximity complement to assign large size dots from the first proximity nozzles. For example, depending on types of paper, types of ink, and the like, some of them have such properties that makes the dot likely spread in a circumferential edge direction thereof on the paper. Accordingly, in such case, an ink droplet ejected through the first proximity nozzle is expected to spread to the void nozzle region even if the dot size remains being a normal one.

In the embodiment, for the sake of convenience of the explanation, the discussion has been focused only on black ink. However, other color inks can be processed in the same manner as the black ink. That is, in FIG. 5, the nozzle N34 is indicated as a non-ejection nozzle in the case of cyan ink, the nozzle N37 is indicated as a non-ejection nozzle in the case of magenta ink, and the nozzle N38 is indicated as a non-ejection nozzle in the case of yellow ink. Note that, however, in the case where a plurality of color inks are to be processed, when void nozzle positions differ depending on the colors, the judgment on which of the first proximity nozzle and second proximity nozzle to eject a droplet earlier is reversed in some case. In such case, the process can be carried out by assigning the order of priority corresponding to the colors of ink. In general, it is thought to be preferable that the order of priority be in the order of black, cyan, magenta and yellow, or in the order of black, magenta, cyan and yellow. Upon assigning the order of priority in the above order, it is sufficient to reverse the scanning direction of the printing head 11 by inserting a null pass as needed. In other words, in the case where the judgment differs depending on the colors being different, the printing state is changed based on the judgment of the color which is given priority.

Moreover, in addition to considering the order of priority of the color inks, an ejection area may be taken into consideration. For example, the order of priority is generally assigned based on black ink. However, in the case where a print region of cyan, magenta, or the like is much wider, it is sufficient to judge whether or not to insert a null pass while allowing the judgment with respect to cyan, magenta, or the like have priority over the judgment with respect to black.

In this embodiment, in the case where it is judged in S106 that the second proximity nozzle ejects a droplet earlier than the first proximity nozzle, the processing to change the printing state is executed in S108 without exception. However, the proximity complement is favorably performed even if the second proximity nozzle ejects a droplet earlier than the first proximity nozzle in some case, that is, in the case where the degree of bleeding is large, for example. The CPU may not change the ejection state in S108 in the case where the degree of bleeding is greater than a predetermined threshold. The judgment on the degree of bleeding can be made based on types of paper. For example, it is also possible to judge that the bleeding is likely to occur in plain paper, and that the bleeding is unlikely to occur in glossy paper.

Second Embodiment

Because the nozzle pitch matches the dot pitch in the printing head 11 of the first embodiment, the printing of one band width is completed by a single pass. Meanwhile, in the case where the nozzle pitch does not match the dot pitch, the printing of one band width is completed by performing the scanning a plurality of times.

Figure 7:
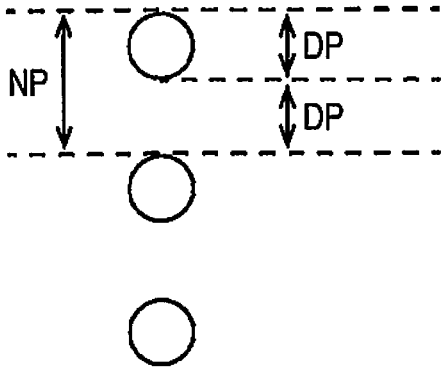
FIG. 7 is a schematic diagram illustrating a nozzle of another printing head.
Figure 8:
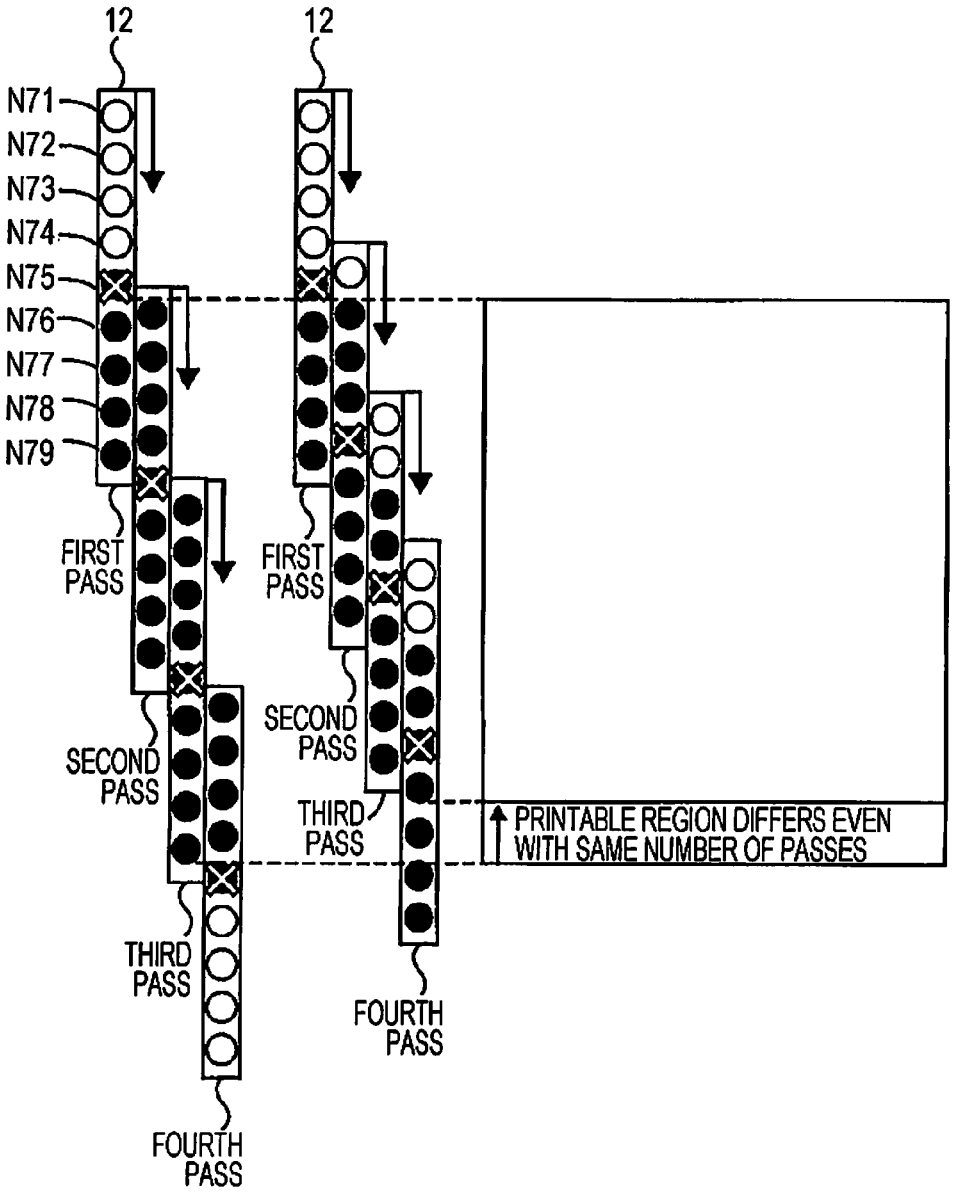
FIG. 8 is a diagram illustrating a printing state using the above nozzle.
Figure 9:
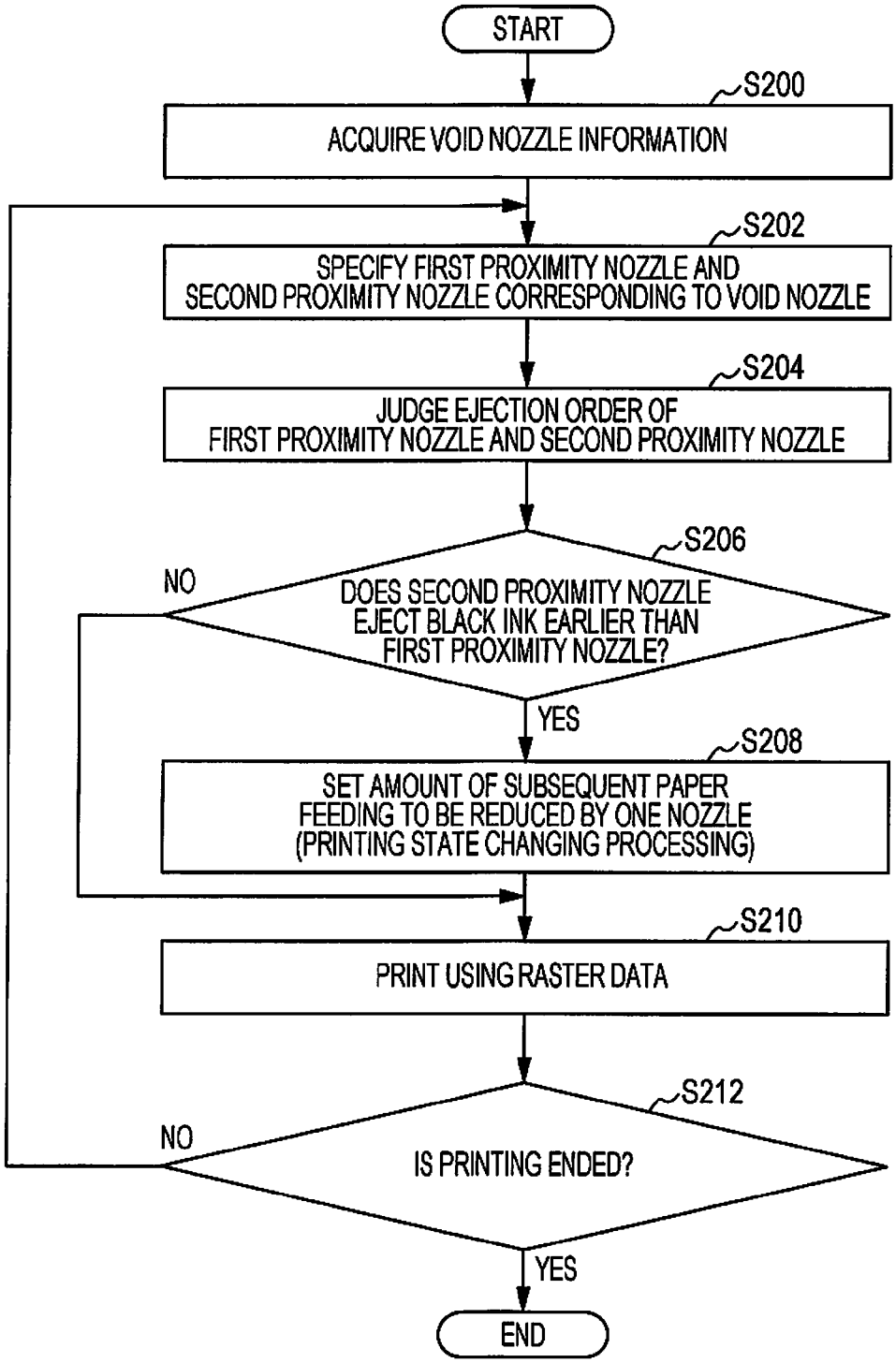
FIG. 9 is a flowchart of a print process in which a desired printing state is realized.

FIG. 7 is a schematic diagram illustrating a nozzle of another printing head. FIG. 8 is a diagram illustrating a printing state using the above nozzle. FIG. 9 is a flowchart of a print process in which the above printing state is realized.

As shown in FIG. 7, as an example, a nozzle pitch NP of a printing head 12 is twice a dot pitch DP in terms of length. An example of the printing head 12 in which nine nozzles N71 to N79 are formed in a single row at the nozzle pitch NP which is twice the dot pitch DP is illustrated for the sake of convenience of the explanation. As shown in FIG. 8, because dots cannot be assigned to the overall region of one band width by a single pass carried out by the printing head 12, it is repeated to feed the paper substantially by half a band width each time so as to fill an area between the dots, to which dots cannot be assigned by a single pass, with dots in a subsequent pass.

In the case where a non-ejection nozzle is not present, printing of a first pass is performed using substantially half of the whole nozzles, that is, the nozzles N75 to N79, as illustrated on the left in FIG. 8. Then, the paper is fed by nine-dot pitches and printing is performed using all the nozzles N71 to N79 in a second pass. Thereafter, it is repeated to feed the paper by nine-dot pitches each time and perform the printing using all the nozzles N71 to N79.

Here, it is assumed that the nozzle N75 is a non-ejection nozzle. Second proximity nozzles configured to assign second proximity dots are the nozzles N74 and N76 adjacent thereto, while first proximity nozzles configured to assign first proximity dots are the nozzle N79 used in the previous pass and the nozzle N71 to be used in the next pass.

Accordingly, in the case where printing is continued under the above-mentioned condition, an ink droplet is attached by the second proximity nozzle N76 in the second pass and thereafter an ink droplet is attached by the first proximity nozzle N71 in a third pass. As a result, the ink droplet ejected by the first proximity nozzle N71 is attracted in a direction toward the second proximity dot side. To deal with this issue, a print process shown in FIG. 9 is carried out. Note that, on the upper side relative to the nozzle N75, which is a non-ejection nozzle, the above-described issue does not arise because the first proximity nozzle N79 ejects an ink droplet earlier and thereafter the second proximity nozzle N74 ejects an ink droplet.

This print process is also carried out in accordance with raster data. The process is executed by the printer driver 81 of the PC 80 or executed by the control circuit 30 in the printer 10. The CPU configured to execute a predetermined program carries out the process following the flowchart. As such, the PC 80, the control circuit 30, or the like substantially corresponds to the control unit of the droplet ejection control apparatus.

The CPU acquires information on a void nozzle in S200. As for nozzles in FIG. 8, the nozzle N75 is a non-ejection nozzle, and information telling that the nozzle N75 is a void nozzle is acquired.

Upon acquiring the void nozzle information, the CPU specifies, in S202, the first proximity nozzle and the second proximity nozzle respectively configured to eject the first proximity dot and the second proximity dot while taking a dot corresponding to the void nozzle as a reference.

Next, in S204, the CPU judges the ejection order of the first proximity nozzle and the second proximity nozzle. In this embodiment, the CPU refers to three passes of raster data because the first proximity dot is printed in the previous pass and also printed in the next pass.

Referring to the first pass and the second pass, as described above, the ink droplet is ejected earlier by the first proximity nozzle N79 and thereafter the ink droplet is ejected by the second proximity nozzle N74 while taking the nozzle N75, which is a non-ejection nozzle, as a reference. However, referring to the second pass and the third pass, the ink droplet is attached earlier by the second proximity nozzle N76 in the second pass and thereafter the ink droplet is attached by the first proximity nozzle N71 in the third pass.

Being in the above-described state, the CPU judges in S206 that the second proximity nozzle ejects black ink earlier than the first proximity nozzle so as to set an amount of subsequent paper feeding to be reduced by one nozzle in S208 (printing state changing processing), and then performs printing using the raster data in S210. In other words, printing is performed using the nozzles N75 to N79 in the first pass.

Note that a diagram shown substantially in the middle of FIG. 8 depicts a state in which the feeding amount of paper is reduced by one nozzle. As shown in the diagram, because the first proximity nozzles will be, when taking the nozzle N75 being a non-ejection nozzle as a reference, the nozzles N78 and N79 in the next second pass, it means that the ink droplets are ejected beforehand in the first pass. Then, since the second proximity nozzles N74 and N76 eject ink droplets in the second pass, the ejection order is preferable as the proximity complement. At the time of setting the feeding amount of paper to be reduced by one nozzle, because the first proximity nozzle is changed, the dot size of the changed first proximity nozzle may be changed to a larger one. As indicated in a diagram on the right side in FIG. 8, a region in which printing can be performed in the first through third passes exhibits a change between before and after the reduction in the feeding amount of paper. In response to this change, the raster data region referred to in each pass is changed as well.

Thereafter, it is sufficient to repeat the above-discussed print process until the end of the printing is judged in S212.

In the embodiment, as discussed above, it is repeated to fill the area between the dots, to which dots cannot be assigned by a single pass, with dots in a subsequent pass. In the case where the previous pass is taken as a first ejection process and the subsequent pass is taken as a second ejection process, interlace printing is performed by the first ejection process and the second ejection process after the feeding of paper, and in the second ejection process, dots are assigned to the area between the dots ejected in the first ejection process.

In the processings of S200 to S206, it is judged whether or not the second proximity dot is ejected in the first ejection process when the feeding amount of paper takes a reference value; these correspond to the judgment section. Further, in the case where the above ejection incident occurs, the feeding amount of paper is changed before the second ejection process so that the dots which the predetermined nozzles assign are ejected between the second proximity dots in the processing of S208; as such, this processing corresponds to the changing section.

It is needless to say that the invention is not limited to the above embodiments. It goes without saying, for those skilled in the art, that the following are included as embodiments of the invention:

the invention is applied in a manner in which the combinations of the members, configurations, and so on that are disclosed in the aforementioned embodiments are capable of being replaced with each other and appropriately changed.

the invention is applied in a manner in which members, configurations, and so on, although not disclosed in the aforementioned embodiments, that are known techniques and can replace or can be replaced with the members, configurations, and so on disclosed in the aforementioned embodiments, are appropriately employed for the replacement, and the combination thereof is changed.

the invention is applied in a manner in which members, configurations, and so on, although not disclosed in the aforementioned embodiments, that can be considered, by those skilled in the art based on the known techniques and the like, to be capable of being used as substitutes for the members, configurations, and so on disclosed in the aforementioned embodiments, are appropriately employed for the replacement, and the combination thereof is changed.

This application claims priority under 35 U.S.C. §119 to Japanese Patent Application No. 2016-090386, filed Apr. 28 2016. The entire disclosure of Japanese Patent Application No. 2016-090386 is hereby incorporated herein by reference.

What is claimed is:

1. A droplet ejection control apparatus that causes a droplet ejection apparatus including a head in which a plurality of nozzles are disposed being aligned in a predetermined direction to perform printing, the droplet ejection control apparatus comprising:

a judgment section that judges, taking a certain incorrect ejection position as a reference, whether or not a printing state is such that a second proximity dot lands earlier than a first proximity dot; and a changing section that changes, when it is judged that an ejection state is such that the second proximity dot lands earlier than the first proximity dot, the ejection state to an ejection state in which the first proximity dot lands earlier than the second proximity dot.

2. The droplet ejection control apparatus according to claim 1, wherein sizes of a plurality of dots can be selected, and the first proximity dot takes a large dot size.

3. The droplet ejection control apparatus according to claim 1, wherein the changing section changes a feeding amount of paper.

4. The droplet ejection control apparatus according to claim 3, wherein interlace printing is performed by a first ejection process and a second ejection process after paper feeding, and in a case where, in the second ejection process, a dot is assigned between dots ejected in the first ejection process, if the judgment section judges that the second proximity dot is ejected in the first ejection process when a feeding amount of paper takes a reference value, the changing section changes the feeding amount of paper before the second ejection process so that the dot assigned by the predetermined nozzle is ejected between the second proximity dots.

5. The droplet ejection control apparatus according to claim 1, wherein the changing section moves the head in a paper traversing direction without the head ejecting a droplet by the head.

6. The droplet ejection control apparatus according to claim 5, wherein the head includes a plurality of nozzle rows disposed at positions where raster line positions of the respective nozzles are different, and the first proximity and the second proximity are reversed depending on the movement of the head.

7. The droplet ejection control apparatus according to claim 1, wherein a degree of bleeding is judged, and in the case where the degree of bleeding is greater than a predetermined threshold, the changing section does not change the ejection state.

8. The droplet ejection control apparatus according to claim 7, wherein the degree of bleeding is judged based on types of paper.

9. The droplet ejection control apparatus according to claim 1, wherein, in the case where the judgement made by the judgment section differs depending on colors being different, the changing section performs changing operation based on judgment of a color which is given priority.

10. A droplet ejection control method that causes a droplet ejection apparatus including a head in which a plurality of nozzles are disposed being aligned in a predetermined direction to perform printing, the method comprising:

changing a printing state, in the case where the printing state is such that a second proximity dot lands earlier than a first proximity dot when taking a certain incorrect ejection position as a reference, to another printing state in which the first proximity dot lands earlier than the second proximity dot.

11. A droplet ejection apparatus that includes a head in which a plurality of nozzles are disposed being aligned in a predetermined direction, the apparatus comprising:

a judgment section that judges, taking a certain incorrect ejection position as a reference, whether or not a printing state is such that a second proximity dot lands earlier than a first proximity dot; and a changing section that changes, when it is judged that an ejection state is such that the second proximity dot lands simultaneously with or earlier than the first proximity dot, the ejection state to an ejection state in which the first proximity dot lands earlier than the second proximity dot.

12. A droplet ejection control apparatus that causes a droplet ejection apparatus including a head in which a plurality of nozzles are disposed being aligned in a predetermined direction to perform printing, the droplet ejection control apparatus comprising:

a judgment section that judges, taking a certain incorrect ejection position as a reference, whether or not landing order is such that a second proximity dot lands earlier than a first proximity dot; and a changing section that reverses the landing order when it is judged that the second proximity dot lands earlier than the first proximity dot.

* * * * *